United States Patent [19]

Kay

[11] Patent Number: 4,527,539

[45] Date of Patent: Jul. 9, 1985

[54] GAS HOTPLATE

[75] Inventor: Arthur S. Kay, Burnley, England

[73] Assignee: Burco-Dean Limited, Lancashire, England

[21] Appl. No.: 516,403

[22] Filed: Jul. 25, 1983

[30] Foreign Application Priority Data

Jul. 24, 1982 [GB] United Kingdom ..... 8221485

[51] Int. Cl.[3] ..... F24C 3/00

[52] U.S. Cl. ..... 126/39 R; 126/39 H; 126/214 C

[58] Field of Search ..... 126/39 R, 39 E, 39 H-39 K, 126/39 M, 214 C, 214 D; 239/558, 559

[56] References Cited

U.S. PATENT DOCUMENTS 3,606,612 9/1971 Reid ..... 126/39 V 3,809,055 5/1974 Craver ..... 126/39 H

*Primary Examiner*—Carroll B. Dority, Jr.

*Attorney, Agent, or Firm*—Sughrue, Mion, Zinn, Macpeak, and Seas

[57] ABSTRACT

A gas hotplate for use in a gas cooker comprising a gas burner (1) having a gas supply (6) and a burner head (9) comprising therein at least three spaced groups of apertures (10) at which apertures (10) gas is burnt, such that between the groups of apertures (10) gaps are provided around the burner head (9) where the intensity of the flame is reduced and a pan support (3) comprising at least three members (15), but not more members (15) than there are groups of apertures (10). The members (15) extend radially towards the center of the burner head (9) and can be aligned with the gaps between the groups of apertures (10). The gas hotplate further comprises means whereby the pan support (3) can be fixed in position relative to the burner head (9) with its support members (15) in alignment with the gaps between the groups of apertures (10) therein.

5 Claims, 2 Drawing Figures

GAS HOTPLATE

Figure 1:
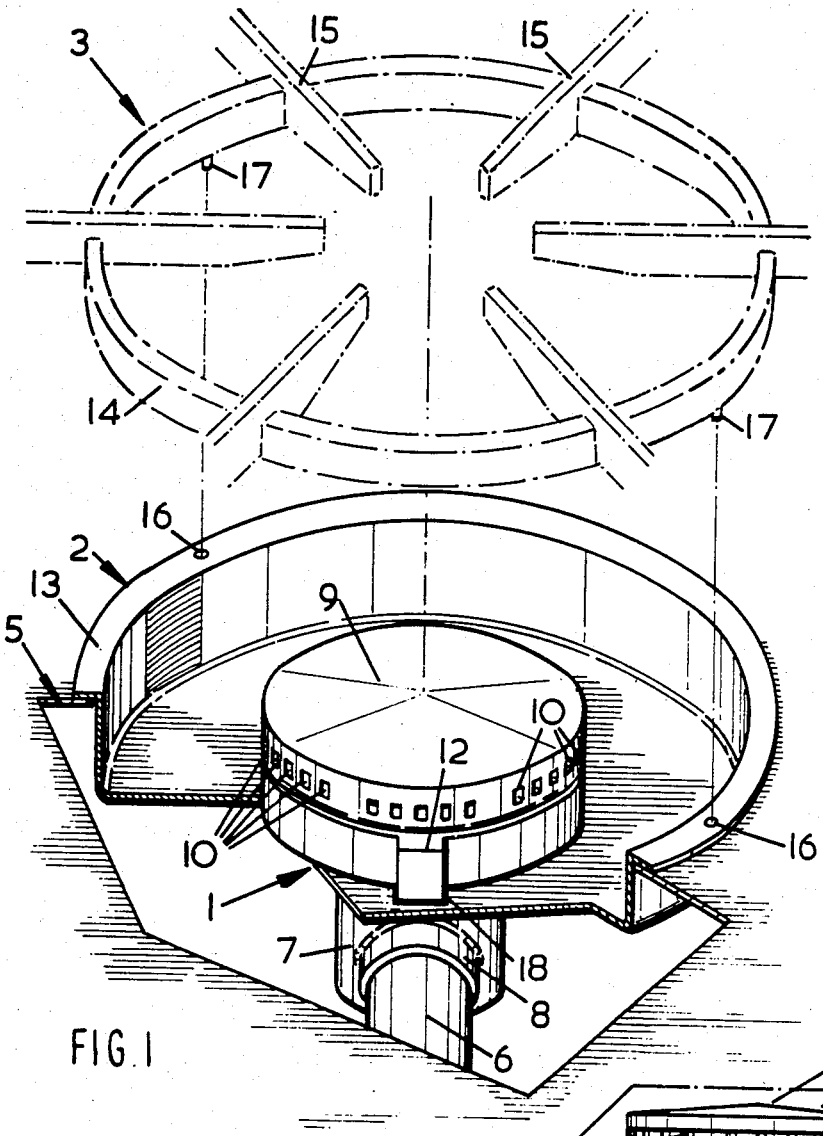

The present invention relates to a gas hotplate and in particular to a gas hotplate for mounting in a glass surface.

Conventional hotplates comprise a gas burner having a burner head to which gas is controllably fed for burning, a spillage bowl which closely surrounds the burner head and the bottom of which lies just below the level of the burner head, and a pan support comprising fins which extend radially from the edge of the spillage bowl towards the centre of the burner head and on which a pan can be supported over the flame of the burner head. The hotplate assembly is mounted in an aperture in the surface of a cooker top, which is comprised of steel coated in enamel to facilitate cleaning and to protect the steel thereunder.

It is essential in a gas hotplate that the fins of the pan support are not located so as to lie directly in the flame of the burner head, and to this end the spacing between the apertures located around the burner head, at which gas is burnt, is increased at regular intervals. This has the effect of providing regularly spaced positions around the burner head where the intensity of the flame is reduced and in which positions the fins of the pan support can be located.

However, since it must be possible to remove the spillage bowl and pan support to facilitate cleaning, some means of ensuring that the pan support is always replaced with its fins extending into those positions around the burner head of reduced flame must be provided. To this end the pan support is provided with locating lugs which engage in holes provided in the surface of the cooker top to ensure that the pan support is always replaced in the same position relative to the burner head.

The provision of holes in an enamel coated, steel cooker top presents no problems. However, in order to keep pace with the "clean" image presented by manufacturers of electric cookers, gas cooker manufacturers are beginning to include in their cooker ranges cookers with glass tops, which are easy to clean and aesthetically pleasing. The provision of holes to locate the pan support in these glass topped cookers presents real problems as the holes tend to set up fracture lines between each other, unless drilled over 50 mm apart.

In addition, the provision of holes in the cooker surface around the hotplate provides an ideal collecting place for particles of food, and considerably reduces the "clean" appearance of the gas cooker.

It is an object of the present invention to provide a hotplate for mounting in a cooker surface in which the need to provide holes in the cooker surface to locate the pan support relative to the burner head is obviated.

According to the present invention there is provided a gas hotplate for use in a gas cooker comprising a gas burner having a gas supply and a burner head comprising therein at least three spaced groups of apertures, at which apertures gas is burnt, such that between the groups of apertures gaps are provided around the burner head where the intensity of the flame is reduced and a pan support comprising at least three members, but not more members than there are groups of apertures, which members extend radially towards the centre of the burner head and which can be aligned with the gaps between the groups of apertures, wherein the gas hotplate comprises means whereby the pan support can be fixed in position relative to the burner head with its support members in alignment with the gaps between the groups of apertures therein.

The gas hotplate is mounted in an aperture in the surface of a cooker, the surface of which is preferably comprised of glass.

Preferably the gas hotplate comprises a spillage bowl which is removably located closely about and generally below the burner head and is supported in position about the burner head by means of a rim provided around the edge thereof which rests on the edge of the aperture in the cooker surface.

The pan support may be fixed in position relative to the burner head by means of the radial members, which extend to the burner head and engage with the gaps provided therein.

Alternatively the spillage bowl is fixed in position relative to the burner head and comprises means whereby the pan support is secured thereto with its support members in alignment with the gaps between the groups of apertures in the burner head.

Preferably the means by which the spillage bowl is fixed in position relative to the burner head comprises a kep provided on the side of the burner head which engages in a slot in the spillage bowl to lock them in position relative to one another.

Preferably the means by which the pan support is fixed in position relative to the spillage bowl comprises a lug provided on the pan support which engages in a corresponding aperture in the rim of the spillage bowl.

Figure 2:
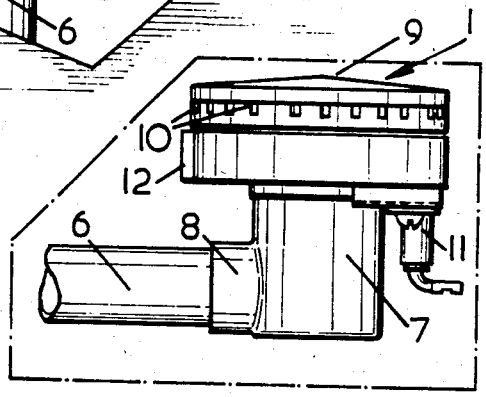

An embodiment of the present invention will now be described, by way of example, with reference to the accompanying drawing, which shows a partially exploded perspective view (FIG. 1) of a gas hotplate according to the present invention and also a plan view (FIG. 2) of part of the spillage bowl.

Referring to the accompanying drawing there is shown a gas hotplate according to the present invention, comprising a gas burner 1, a spillage bowl 2 and a pan support 3, which, when assembled, as described hereinbelow, are mounted in an aperture provided in a glass sheet 5, forming the top of a glass topped cooker (not shown).

The gas burner 1 is positioned centrally in the aperture and comprises a gas inlet pipe 6, which is connected to the body 7 of the gas burner 1 by means of a sleeve 8 in which the pipe 6 is secured in any convenient manner, and a burner head 9 at which the gas is burnt. In order to give the cooker an aesthetically pleasing slimline appearance the overall height of the gas burner 1 is kept small. In fact, in the gas burner shown in the accompanying drawing the height of the body 7 lying below the working surface of the cooker is only 30 mm. Located around the head 9 of the burner 1 are apertures 10 at which the gas is burnt. The spacing between the apertures 10 is increased every five apertures to provide regularly spaced gaps around the burner head 9 at which the intensity of the flame is reduced. An ignition electrode 11 is located in the head 9 of the gas burner 1 in the vicinity of the apertures 10, which when a voltage is applied thereto creates a spark to ignite the gas at the head 9.

The spillage bowl 2 is located around the burner head 9 by means of an aperture provided in its base which enables it to be dropped into position over the head 9. In order to enable the spillage bowl 2 to be secured in position relative to the burner head 9 a key 12 is provided on the side of the head 9 which engages in a cut out 18 in the side of the aperture in the base of the spillage bowl 2. A rim 13 provided around the top edge of the spillage bowl 2 rests on the top of the glass sheet 5 to prevent the spillage bowl 2 from dropping too far below the burner head 9.

The pan support 3 comprises a ring 14 of the same outside diameter as the spillage bowl 2 to which are secured fins 15 corresponding in number to the number of regularly spaced gaps provided around the head 9 of the gas burner 1. The fins 15 extend radially towards the centre of the ring 14 and must align with the regularly spaced gaps in the burner head 9. In order to ensure that the pan support 3 is always located in this position relative to the burner head 1 holes 16 are provided in the rim 13 of the spillage bowl 2 in which lugs 17 provided on the ring 14 of the pan support 3 engage.

In the arrangement described hereinabove a gas hotplate is provided in which the pan support can always be positioned relative to the burner head with its fin in alignment with the regularly spaced gaps provided therein, without the need to drill holes in the cooker top. This enables fragile and delicate materials, e.g. glass to be used in the cooker top as there is no need to drill locating holes therein and also provides a more aesthetically pleasing arrangement.

It will be appreciated that means other than those described hereinabove of fixing the gas burner and pan support in position relative to each other are possible, for example, the pan support fins may be extended to the burner head and provided with means whereby they engage with the regularly spaced gaps therein. Where this is the case the spillage bowl can be dispensed with and a simple masking member provided around the burner head to mask the aperture in the cooker top.

What is claimed is:

1. A gas hotplate for use in a gas cooker comprising a gas burner having a gas supply and a burner head comprising therein at least three spaced groups of apertures, at which apertures gas is burnt, such that between the groups of apertures gaps are provided around the burner head where the intensity of the flame is reduced and a pan support comprising at least three members, but not more members than there are groups of apertures, which members extend radially towards the centre of the burner head and which can be aligned with the gaps between the groups of apertures, wherein the gas hotplate comprises means whereby the pan support can be fixed in position relative to the burner head with its support members in alignment with the gaps between the groups of apertures therein; wherein the gas hotplate is mounted in an aperture in the surface of a cooker; wherein the surface is comprised of glass; wherein the gas hotplate comprises a spillage bowl which is removably located closely about and generally below the burner head and is supported in position about the burner head by means of a rim provided around the edge thereof which rests on the edge of the aperture in the cooker surface; wherein the spillage bowl is fixed in position relative to the burner head and comprises means whereby the pan support is secured thereto with its support members in alignment with the gaps between the groups of apertures in the burner head; and wherein the means by which the spillage bowl is fixed in position relative to the burner head comprises a key provided on the side of the burner head which engages in a slot in the spillage bowl to lock them in position relative to one another.

2. A gas hotplate according to claim 1 wherein the means by which the pan support is fixed in position relative to the spillage bowl comprises a lug provided on the pan support which engages in a corresponding aperture in the rim of the spillage bowl.

3. A gas hotplate for use in a gas cooker comprising a gas burner having a gas supply and a burner head comprising therein at least three spaced groups of apertures, at which apertures gas is burnt, such that between the groups of apertures there are provided gaps around the burner head where the intensity of the flame is reduced, a spillage bowl removably located closely about and generally below the burner head and supported in position about the burner head by means of a rim provided around the edge thereof and adapted to rest on the edge of an aperture in the surface of a cooker, first complementary interengaging formations on the side of the burner head and on the spillage bowl to lock them together to prevent relative angular movement therebetween, a pan support supported on the spillage bowl and comprising at least three members, but not more members than there are groups of apertures, which extend radially of the burner head in alignment with the gaps between the groups of apertures therein, and second complementary interengaging formations on the pan support and the spillage bowl to secure them against relative angular movement thereby to maintain the alignment between the support members of the pan support and the gaps between the groups of apertures in the burner head.

4. A gas hotplate according to claim 3, wherein the first complementary interengaging formations comprise a key provided on the side of the burner head which engages in a slot in the spillage bowl to lock them in position relative to one another.

5. A gas hotplate according to claim 3 or 4, wherein the second complementary interengaging formations comprise a lug provided on the pan support which engages in a corresponding aperture in the rim of the spillage bowl.

* * * * *